US005304009A

United States Patent [19]

Marshall

[11] Patent Number: 5,304,009

[45] Date of Patent: Apr. 19, 1994

[54] DISPOSABLE TOOTH BRUSH

[76] Inventor: Jeweral E. Marshall, P.O. Box 57, Oldtown, Md. 21555

[21] Appl. No.: 27,640

[22] Filed: Mar. 8, 1993

[51] Int. Cl.[5] ..... A46B 11/00

[52] U.S. Cl. ..... 401/268; 132/309; 132/311; 401/195

[58] Field of Search ..... 132/308, 309, 311; 401/268, 195

[56] References Cited

U.S. PATENT DOCUMENTS

| | | | |
|---|---|---|---|
| 901,835 | 10/1908 | Ringer | 132/311 X |
| 1,349,110 | 8/1920 | Snyder | 132/311 |
| 1,495,675 | 5/1924 | Colt | 132/309 |
| 2,459,285 | 1/1949 | Murphy | 132/311 |
| 4,919,156 | 4/1990 | Gipson | 132/311 X |

FOREIGN PATENT DOCUMENTS

| | | | |
|---|---|---|---|
| 894623 | 3/1944 | France | 401/195 |
| 2480099 | 10/1981 | France | 132/311 |

*Primary Examiner*—Steven A. Bratlie
*Attorney, Agent, or Firm*—Walter G. Finch

[57] ABSTRACT

The invention provides for a disposable toothbrush having a supply of dehydrated toothpaste adhered to a bristle portion attached to an upper member, detachable handle containing a supply of mouth rinse forming a lower member, a toothpick attached to the detachable handle, and a supply of dental floss wrapped around the toothpick. The toothbrush is especially simple in design, but nevertheless is adapted to furnish a complete dental hygiene kit. In the preferred embodiment, the toothbrush includes one and one half ounces of mouth rinse and eight inches of dental floss.

5 Claims, 1 Drawing Sheet

DISPOSABLE TOOTH BRUSH

BACKGROUND OF THE INVENTION

This invention relates to apparatus for use in dental hygiene, and more particularly, to a disposable toothbrush incorporating an amount of dehydrated toothpaste, a reservoir of mouth rinse, a toothpick, and a supply of dental floss.

Too many times, people traveling about forget to pack their toothbrush, floss, or mouthwash. Other times, people find themselves in positions where a dose of oral hygiene could work miracles, but have no means to accomplish this. The present invention addresses these problems with a unique combination of a disposable toothbrush complete with toothpaste, several ounces of mouthwash, a toothpick, and a supply of dental floss. The invention has a particularly simple design and therefore renders itself easy to manufacture. The disposable toothbrush is useful in many places, some of which include hotels, cruise ships, planes, trains, buses, and bus stations.

BEST KNOWN PRIOR ART

The best known prior U.S. art is as follows: U.S. Pat. Nos. 901,835, 2,649,959, 4,865,481, 5,044,386, The prior art includes numerous improvements on the basic toothbrush. Most of these improvements are geared towards the needs which arise during travel. The U.S. Pat. No. 901,835 issued to Ringer teaches a toothbrush with a hollow, removable handle which may be used to carry a dentifrice. Similarly, the Nelson U.S. Pat. No. 5,044,386 discloses a portable dental care unit which includes a lower piece to carry a first dentifrice therein and a recessed portion in an upper piece to carry a second dentifrice therein.

The Hallahan U.S. Pat. No. 2,649,959 discusses a toothbrush package in which the bristles of a portable toothbrush are coated with a mass of dried toothpaste. A disposable toothbrush, toothpaste, mouthwash, and floss combination is the subject of the U.S. Patent issued to Scales. The scales invention includes means to communicate toothpaste kept within a pliable receptacle to the bristles of the toothbrush, a self contained mouthwash container, and a receptacle for a supply of floss.

Yet, as is the case with the Scales invention, most disposable toothbrush inventions have been made unnecessarily complicated with different receptacles containing dentifrices and with conduits connecting reservoirs of toothpaste to the bristle portions of the toothbrushes. In this respect, no prior device offers the combination of a toothbrush, toothpaste, mouthrinse, toothpick, and dental floss in such a simply and easy to manufacture design as does the present invention.

OBJECTS OF THE INVENTION

It is an object of this invention to provide a disposable toothbrush for use in oral hygiene.

Another object of this invention is to provide a novel disposable toothbrush which includes an amount of dehydrated toothpaste pre-applied to the bristles, a reservoir of mouth rinse, a toothpick, and a supply of dental floss.

To provide a disposable toothbrush which consists of an upper member and a lower tubular member is another object of this invention.

To provide a unique toothbrush in which a reservoir of mouth rinse is kept within a lower tubular member is still another object of this invention.

To provide a novel and unique toothbrush in which a supply of dental floss and a toothpick are attached to the outer surface of a lower member is yet another object of this invention.

And to provide a toothbrush which may be discarded after a single use which combines an amount of toothpaste, a reservoir of mouthrinse, a supply of dental floss, and a toothpick in a simple and easy to manufacture design is yet another object of this invention.

BRIEF DESCRIPTION OF THE DRAWINGS

These and other attendant advantages of this invention will become more obvious and apparent from the following detailed specification and accompanying drawings in which.

DESCRIPTION OF THE PREFERRED EMBODIMENTS OF THE INVENTION

Figure 1:
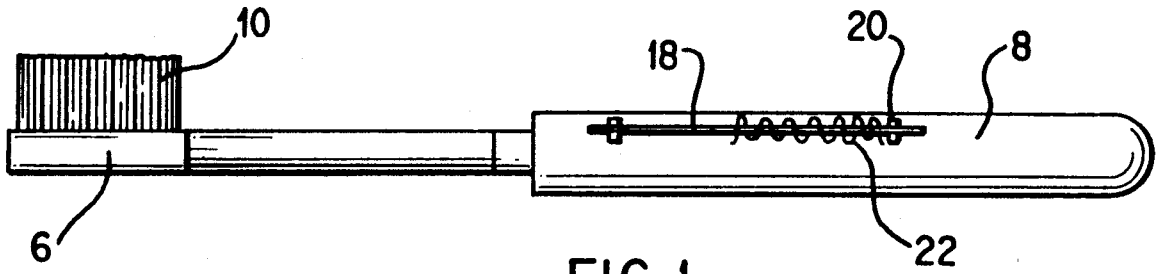
FIG. 1 is a side view of a disposable toothbrush incorporating features of this invention.
Figure 2:
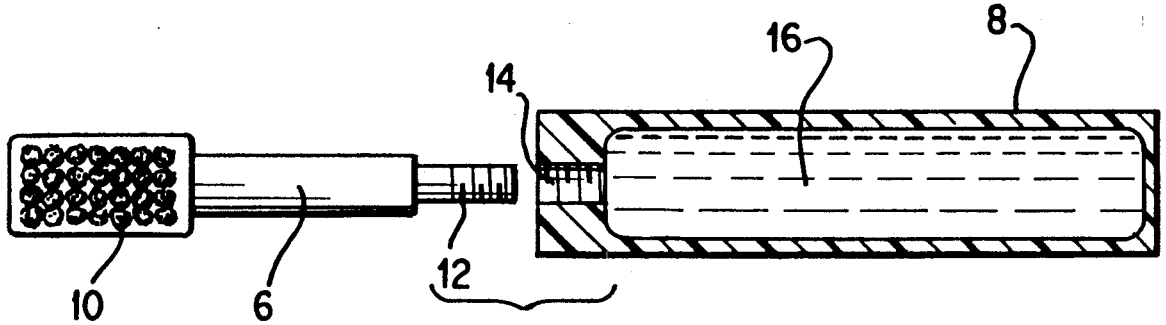
FIG. 2 is a top view of the toothbrush of FIG. 1, illustrating the upper bristle member disconnected from the lower handle member, and further showing a section view of the lower handle member.

Referring to FIG. 1 and FIG. 2 of the drawings, there is shown the preferred embodiment of a disposable toothbrush, whose unique features provide the user with adequate oral hygiene. FIG. 1 illustrates the preferred embodiment of the disposable toothbrush. The toothbrush consists of an upper member 6 and a lower member 8. The two members 6,8 are seen disconnected in FIG. 2.

The upper member 6 has, at one end, a head portion including bristles impregnated with a dehydrated toothpaste 10 extending perpendicularly therefrom. The other end of the upper member 6 is a threaded stem portion 12. The lower member 8 forms the pliable, tubular handle of the toothbrush and holds a reservoir of mouthwash 16 in its interior. An opening 14 in the top end of the lower member 8 communicates with the reservoir of mouthwash 16. The opening 14 on the lower member 8 is internally threaded to receive the threaded stem portion 12 of the upper member 6.

As seen in FIG. 1, a toothpick 18 is attached to the outer surface of the lower member 6 with four fork members 20 which protrude out from the lower member 8. Also, a supply of dental floss 22 is wrapped around the toothpick 18.

Operation of the toothbrush is simple and straightforward. The user inserts the bristle portion covered with dehydrated toothpaste 10 into his or her mouth and begins brushing. The saliva in the user's mouth activates the dehydrated toothpaste contained in the bristles 10. After brushing, the user unscrews the upper member 6 from the lower member 8. The user places the opening 14 of the lower member 8 into his or her mouth, gently squeezes the pliable lower member 8, and thereby receives several ounces of mouthwash 16. If desired, the user can detach the toothpick 18 and dental floss 22 from the forks 20 on the lower member 8 and clean in between his or her teeth. The entire apparatus may then be discarded.

It is intended to be understood that the invention should not be limited to the previous teachings and drawings. Minor design changes would not affect the intent of the invention. Rather, its scope should include all details and embodiments covered in the appended claims.

What is claimed is:

1. A disposable toothbrush for use in oral hygiene, comprising, an upper member and a lower member, said upper member including at one end a head portion including bristle means extending perpendicularly from one side of said head portion, said bristle means having a first supply of a dehydrated dentifrice imprignated therein, said upper member having at a distal end a threaded stem portion, said lower member comprising a pliable tubular toothbrush handle containing a second supply of a liquid dentifrice in its interior, said lower member having an opening leading to said second supply of liquid dentifrice at its top end, said opening internally threaded so as to readily attach to and detach from said threaded stem portion of said upper member, said lower member having a plurality of fork members protruding radially outward from its outer surface, said lower member having a toothpick means carrying a predetermined supply of dental floss detachably wedged in between said plurality of fork members, wherein said lower member forms the handle of said toothbrush when it is threaded to said upper member, and whereby said lower member may be compressed to release said second supply of liquid dentifrice when said lower member is detached from said upper member.

2. A disposable toothbrush for use in oral hygiene as recited in claim 1, wherein said predetermined supply of dental floss is wrapped around said toothpick means, and whereby said toothpick means is secured to the outer surface of said lower member with four of said fork members protruding out from said lower member.

3. A disposable toothbrush for use in oral hygiene as recited in claim 1, whereby said first supply of dehydrated dentifrice contained in said bristle means activates upon saliva contact.

4. A disposable toothbrush for use in oral hygiene as recited in claim 1, whereby said lower member holds one and one half ounces of said second supply of liquid dentifrice.

5. A disposable toothbrush for use in oral hygiene as recited in claim 1, whereby said predetermined supply of dental floss is eight inches long.

* * * * *